United States Patent [19]

Jiang

[11] Patent Number: 4,920,771

[45] Date of Patent: May 1, 1990

[54] CASE LOCK

[76] Inventor: Jy-Chang Jiang, 14, Sec. 1, Shin Ren Rd., Tay Pyng Shi, Taichung Hsien, Taiwan

[21] Appl. No.: 260,563

[22] Filed: Oct. 20, 1988

[51] Int. Cl.[5] ..... E05B 65/48; E05B 37/02

[52] U.S. Cl. ..... 70/4; 70/75; 70/312

[58] Field of Search ..... 70/3, 4, 5, 73, 74, 70/75, 76, 312

[56] References Cited

U.S. PATENT DOCUMENTS

| | | | |
|---|---|---|---|
| 3,434,314 | 3/1969 | Atkinson | 70/76 |
| 3,597,945 | 8/1971 | Feinberg | 70/74 |
| 4,761,974 | 8/1988 | Lii | 70/4 |
| 4,782,673 | 11/1988 | Castelli | 70/72 |

*Primary Examiner*—Robert L. Wolfe

*Attorney, Agent, or Firm*—Fleit, Jacobson, Cohn, Price, Holman & Stern

[57] ABSTRACT

A lock for a case having a cover portion having a first hooking piece includes a housing mounting therein a conventional numerical lock assembly, and a hooking member which is pivotally connected to the housing and mechanically coupled to the numerical lock assembly and has a second hooking piece such that when the numerical lock assembly is in an unlocked state, the second hooking piece will be able to be disengaged from the first hooking piece to allow the case in an unlocked state also.

2 Claims, 3 Drawing Sheets

CASE LOCK

BACKGROUND OF THE INVENTION

The present invention relates to a lock, and more particularly to a numerical lock.

The conventional case lock used for a suitcase or a trunk having an upper casing and a lower casing includes a lock body mounted on the lower casing and a hooking plate mounted on the upper casing so that when the lock body and the hooking plate are engaged together, the case is locked. Such structure has the following disadvantages:

1. Since the lock body and the hooking plate are respectively mounted on the lower and upper casings, the assembling procedure is relatively time-consuming.
2. Both of the lock body and the hooking plate will occupy a certain space of the storing room provided by the case.
3. Since the hooking plate protrudes beyond the edge of the upper housing, it may hook or hurt one's hand or the article in the mid course of his taking the article from the storing room.

It is therefore tried by the Applicant to deal with the above shortcomings encountered by the prior art.

SUMMARY OF THE INVENTION

It is an object of the present invention to provide a case lock being relatively time-saving in assembly.

It is further an object of the present invention to provide a case lock occupying no storing space provided by a case.

It is yet an object of the present invention to provide a case lock freeing one's hand or the article from being hurt or damaged in the mid course of his taking the article from the storing space of a suitcase or a trunk.

According to the present invention, a lock includes a housing having holes, numerical wheels protruding from the holes, an actuating plate driven by the numerical wheels to have a first position when they have correct numbers and a second position when they are in an incorrect number set, a hooking member pivotally connected to the housing and having a first hooking piece, a securing plate pivotally connected to the housing and fixed to a body portion of a case having a cover portion having a second hooking piece, and an engaging medium pivotally fixed to the housing and having a first engaging portion engaging with a tongue end of the securing plate and a second engaging portion engagable with the actuating plate so that when the second engaging portion engages with the actuating plate in the second position, the first and second hooking pieces will hook with each other to thus lock the case.

The present invention may best be understood through the following description of the preferred embodiment with reference to the accompanying drawings, in which:

DETAILED DESCRIPTION OF THE PREFERRED EMBODIMENT

Figure 1:
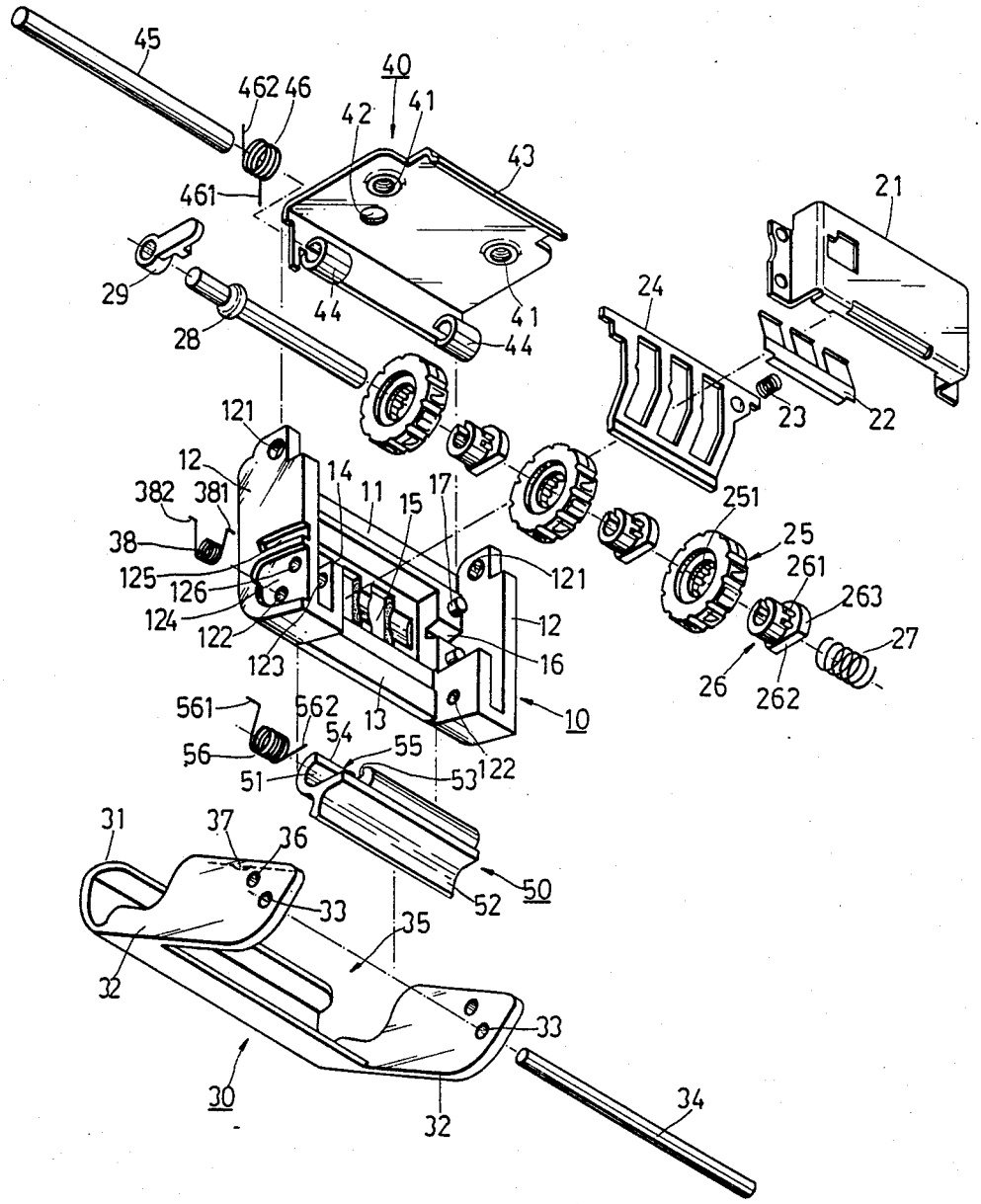
FIG. 1 is an exploded view showing a preferred embodiment of a case lock according to the present invention.
Figure 2:
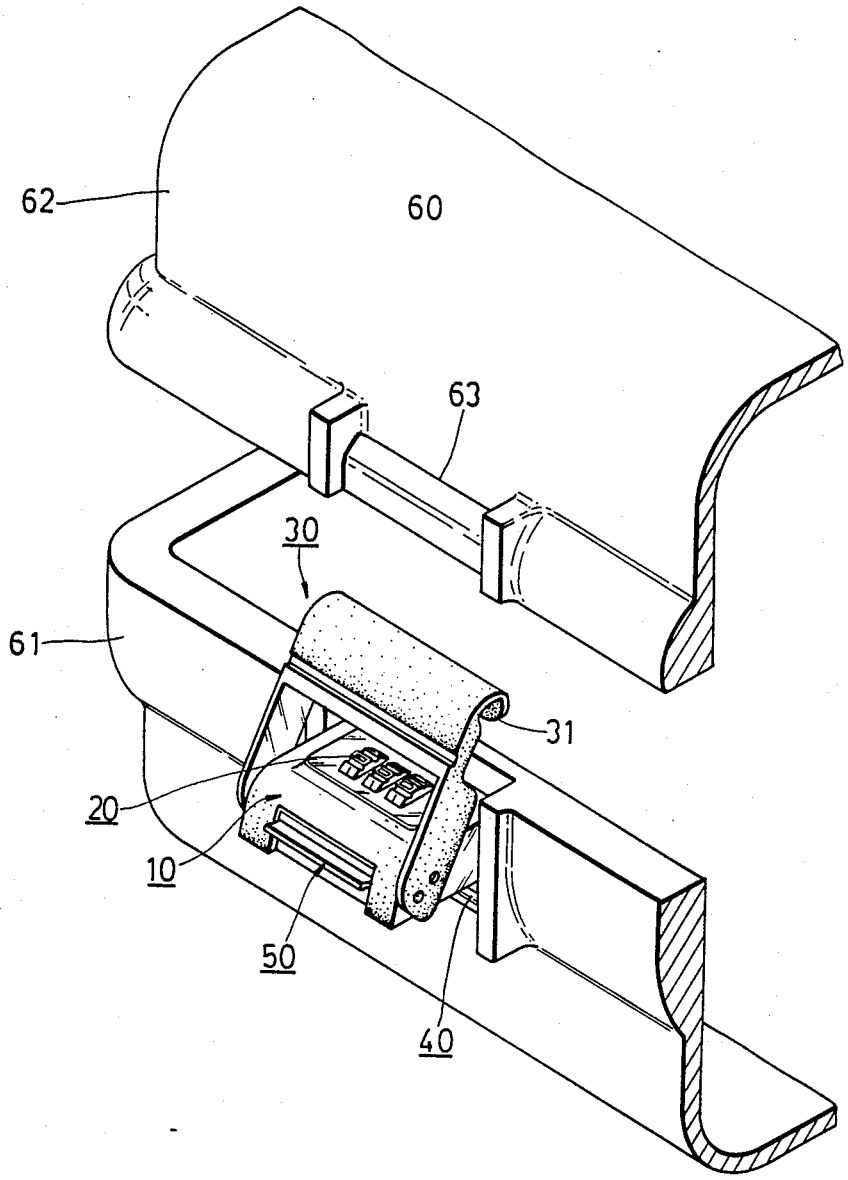
FIG. 2 is a perspective view showing an assembled case lock in FIG. 1 incorporated on a case.

Referring now to FIGS. 1–5(B), a lock according to the present invention includes a housing 10, a numerical lock assembly 20, a hooking member 30, a securing plate 40 secured to a body portion 61 of a case 60 having a cover portion 62 having a hooking piece 63, and an engaging medium 50.

Housing 10 includes a face plate 11, two lateral side plates 12 respectively having two upper holes 121 and two lower holes 122, a lower space pivotally mounting therein engaging medium 50, a shallowed portion 14 on face plate 11 having three regularly spaced holes 15, two grooved portions 16 on face plate 11, and rivets 17. One of side plates 12 further includes a positioning hole 123, a shallowed portion 124, an arcuate groove 125, and further a positioning hole 126.

Numerical lock assembly 20 having been known in the prior art includes a housing 21, a resilient finger plate 22, a first compression spring 23, an actuating plate 24, numerical wheels 25, sleeve members 26, a second compression spring 27, a shaft 28 and a number-changing initiator 29, in which axial projections 261 of sleeve members 26 are respectively kept in engagement with teeth 251 of numerical wheels 25 by spring 27 so that when numerical wheels 25 carrying therewith sleeve members 26 are respectively rotated to rest all the flattened portions 262 of sleeve members 26 on actuating plate 24, spring 23 pivots actuating plate 24 to unlock the numerical lock assembly 20 and when any one of numerical wheels 25 is rotated to rest on the arcuate portion 263 of the respective sleeve member 26 on actuating plate 24, actuating plate 24 is thereby pivoted to lock numerical lock assembly 20 which is mounted in shallowed portion 14 to protrude numerical wheels 25 from holes 15 and has shaft 28 mounted between grooved portions 16 and housing 21 riveted to face plate 11 by rivets 17.

Hooking member 30 includes a hooking piece 31, two side plates 32 respectively having two holes 33 through which and holes 122 a pin 34 passes to pivotally connect together housing 10 and hooking member 30, and a space 35 defined among hooking piece 31 and side plates 32 and capable of receiving therein face plate 11. One of side plates 32 includes a positioning hole 36 retaining therein an end 382 of a torsional spring 38 which is sleeved on pin 34 and received in shallowed portion 124 and has an opposite end 381 retained in positioning hole 126, and a projection 37 guided in arcuate groove 125 in order to confine the range that hooking member 30 whould be pivoted by spring 38 with respect to housing 10.

Securing plate 40 includes threaded holes 41 through which screws can be screwed to body portion 61, a hole 42 passing therethrough number-changing piece 29 protruding beyond housing 21, a tongue end 43, and two hinging rings 44 through which and holes 121 a pin 45 passes to pivotally connect together securing plate 40 and housing 10. A torsional spring 46 is sleeved on pin 45 and includes two free ends 461, 462 respectively urging against face plate 11 and securing plate 40 in order to tend to usually urging them apart with a predetermined included angle.

Engaging medium 50 includes a shaft hole 51 rotatably mounted to pin 34, a handle portion 52 for hand-operation, a first engaging portion 53 engagable with tongue end 43, a second engaging portion 54 engagable with actuating plate 24, and a receiving groove 55 receiving therein a torsional spring 56 which is sleeved on pin 34 and includes two free ends 561, 562 respectively retained in positioning hole 123 and groove 55 for usually tending to urge housing 10 and engaging medium 50 in a predetermined pivoted relationship with respect to each other.

Figure 5B:
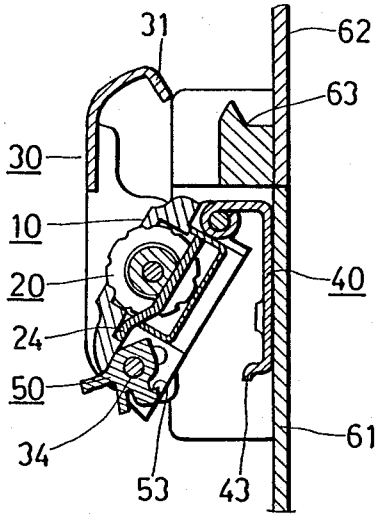
FIGS. 5(A) and 5(B) are sectional views respectively showing a locked state and an unlocked state of a case lock in FIG. 1.
Figure 5A:
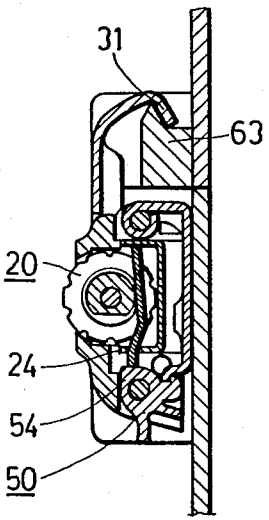
Figure 4:
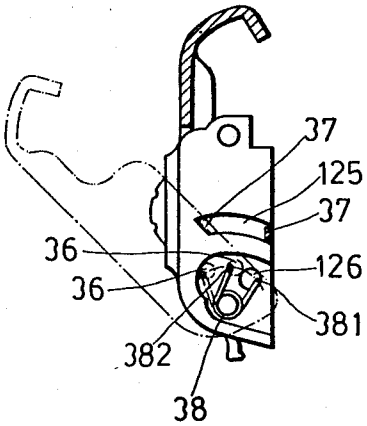
FIG. 4 is a schematic view showing the relative position between a housing and a hooking member of a case lock in FIG. 1.
Figure 3:
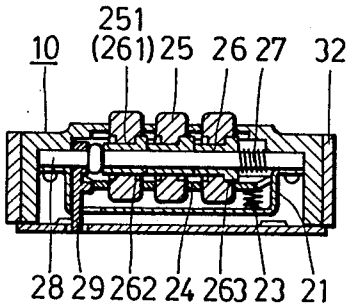
FIG. 3 is a sectional view showing a numerical lock in FIG. 1 in an unlocked state.

In a locking state of the present lock, as shown in FIG. 5(A), second engaging portion 54 engages with actuating plate 24 and engaging medium 50 is thus prevented from being pivoted with respect to housing 10 so that hooking pieces 31, 63 hook together to thus lock the case 60. In an unlocked state of the present lock, as shown in FIG. 5(B), actuating plate 24 no longer stops against second engaging portion 54 so that engaging medium 50 can be pivoted to disengage first engaging portion 53 from tongue end 43 and thus torsional spring 38 and 46 will respectively pivot apart hooking member 30 and housing 10 as well as securing plate 50 and housing 10 to disengage hooking piece 31 from hooking piece 63 to so unlock the case 60.

Certainly, torsional spring 56 can have its two free ends 561, 562 respectively retained in positioning hole 123 and groove 55 in the manner that housing 10 and engaging medium 50 are tended to be kept in the state shown in FIG. 5(A).

What I claim is:

1. A case lock comprising:

a housing having a plurality of holes and two first side plates one of which has an arcuate groove;

a plurality of coaxial numerical wheels rotatably mounted in said housing and respectively protruding from said holes for being rotated outside of said housing;

an actuating plate mounted in said housing and driven by said numerical wheels to have a first position when they have correct numbers and a second position when they are in an incorrect number set;

a hooking member pivotally connected to said housing and having a first hooking piece and two second side plates which pivotally connect therebetween said two first side plates and one of which has a projection guided in said accurate groove for defining a first predetermined included angle between said housing and said hooking member;

a first elastic member mounted between said housing and said hooking member for usually tending to urge them apart with said first predetermined included angle;

a securing plate pivotally connected to said housing, having a tongue end and adapted to be fixed to a body portion of a case having a cover portion having a second hooking piece engagable with said first hooking piece;

a second elastic member mounted between said housing and said securing plate for usually tending to urge them apart with a second predetermined included angle;

an engaging medium pivotally fixed to said housing, and having a first engaging portion engaging with said tongue end, a handle portion for allowing said engaging medium to be rotated to engage together said first engaging portion and said tongue end if said case is to be re-locked after being unlocked, and a second engaging portion engagable with said actuating plate so that when said second engaging portion engages with said actuating plate in said second position, said first and second hooking pieces engage with each other to thus lock said case;

a third elastic member mounted between said housing and said engaging medium for usually tending to urge them in a pivoted relationship with respect to each other; and first and second pin respectively pivotally pinning together said securing plate and said housing as well as said engaging medium and said housing.

2. A lock according to claim 1 wherein said first elastic member is a torsional spring sleeved on said first pin and said second and third elastic members are torsional springs sleeved on said second pin.

* * * * *